US009193554B2

(12) United States Patent
Ansermot

(10) Patent No.: US 9,193,554 B2
(45) Date of Patent: Nov. 24, 2015

(54) BRAKING DEVICE FOR A FLAT ELEMENT IN SHEET FORM AND METHOD FOR CLEANING SUCH A DEVICE

(71) Applicant: BOBST MEX SA, Mex (CH)

(72) Inventor: Jean-Claude Ansermot, Estavayer-le-lac (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 14/396,165

(22) PCT Filed: Apr. 19, 2013

(86) PCT No.: PCT/EP2013/001165

§ 371 (c)(1),
(2) Date: Oct. 22, 2014

(87) PCT Pub. No.: WO2013/164070

PCT Pub. Date: Nov. 7, 2013

(65) Prior Publication Data

US 2015/0102554 A1 Apr. 16, 2015

(30) Foreign Application Priority Data

May 3, 2012 (EP) ..... 12003418

(51) Int. Cl.
*B65H 29/68* (2006.01)
*B65H 5/22* (2006.01)
(Continued)

(52) U.S. Cl.
CPC ..... *B65H 29/686* (2013.01); *B65H 5/222* (2013.01); *B65H 7/02* (2013.01); *B65H 7/20* (2013.01);
(Continued)

(58) Field of Classification Search
CPC ..... B65H 3/122; B65H 3/14; B65H 7/16; B65H 9/05; B65H 11/105; B65H 29/241; B65H 29/242; B65H 29/248; B65H 29/686; B65H 2301/531; B65H 2406/10; B65H 2406/1132; B65H 2406/14; B65H 2406/30; B65H 2406/31; B65H 2406/35; B65H 2406/351; B65H 2406/3511; B65H 246/363; B65H 2406/366; B65H 2601/261
USPC ..... 271/183
See application file for complete search history.

(56) References Cited

U.S. PATENT DOCUMENTS 3,779,545 A 12/1973 Schuhmann et al.
3,933,351 A 1/1976 Mayer et al.
(Continued)

FOREIGN PATENT DOCUMENTS

EP 1 935 820 A2 6/2008
FR 2 146 045 A5 2/1973
FR 2 252 215 A1 6/1975

OTHER PUBLICATIONS

International Search Report dated Aug. 16, 2013 issued in corresponding International patent application No. PCT/EP2013/001165.

*Primary Examiner* — Jeremy R Severson
(74) *Attorney, Agent, or Firm* — Ostrolenk Faber LLP

(57) ABSTRACT

A braking device 1 for braking advancing of the rear portion of a flat sheet when the sheet is advanced and is displaced by being pulled by its front portion: a surface over which the sheet is advanced, a suction hole 10 in the surface which communicates with an exhaust orifice 30 via an air circulation channel 20, a principal compressed air injection device 40 which, by a Venturi effect, indirectly generates a braking suction air flow through the suction hole 10, a secondary compressed air injection device 50 which, by a Venturi effect, indirectly generates a cleaning suction air flow through the suction hole 10.

15 Claims, 2 Drawing Sheets

(51) Int. Cl.
*B65H 7/02* (2006.01)
*B65H 7/20* (2006.01)

(52) U.S. Cl.
CPC ..... *B65H 2301/531* (2013.01); *B65H 2406/31* (2013.01); *B65H 2406/3511* (2013.01); *B65H 2406/3661* (2013.01); *B65H 2801/42* (2013.01)

(56) References Cited

U.S. PATENT DOCUMENTS 3,972,523 A * 8/1976 Brandes ..... 271/183
5,951,006 A * 9/1999 Biegelsen et al. ..... 271/195

* cited by examiner

Fig. 1
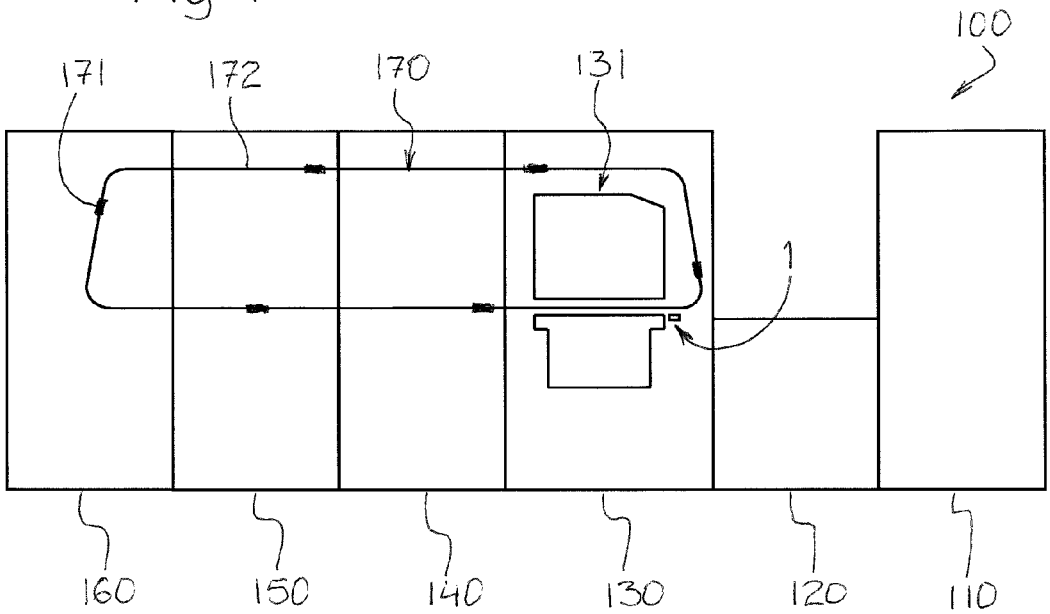
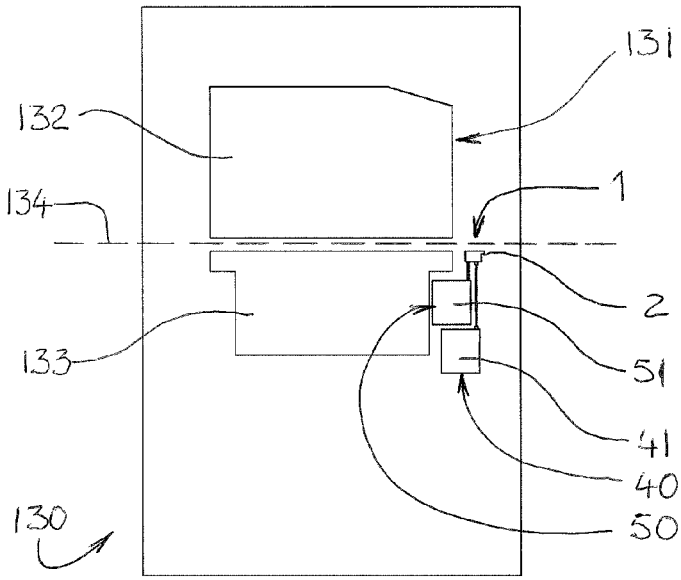
Fig. 2

Fig. 3
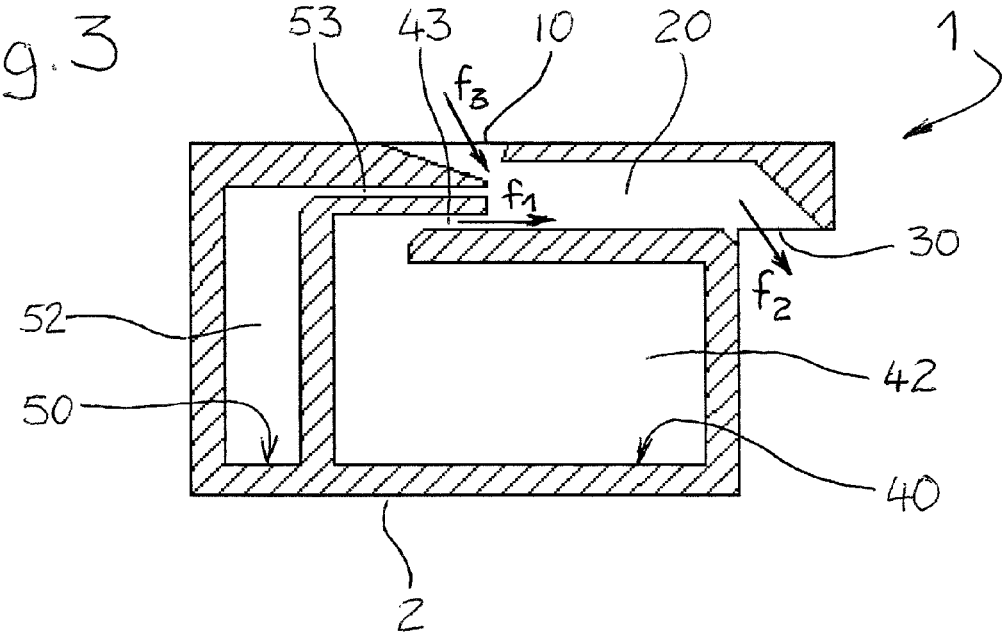
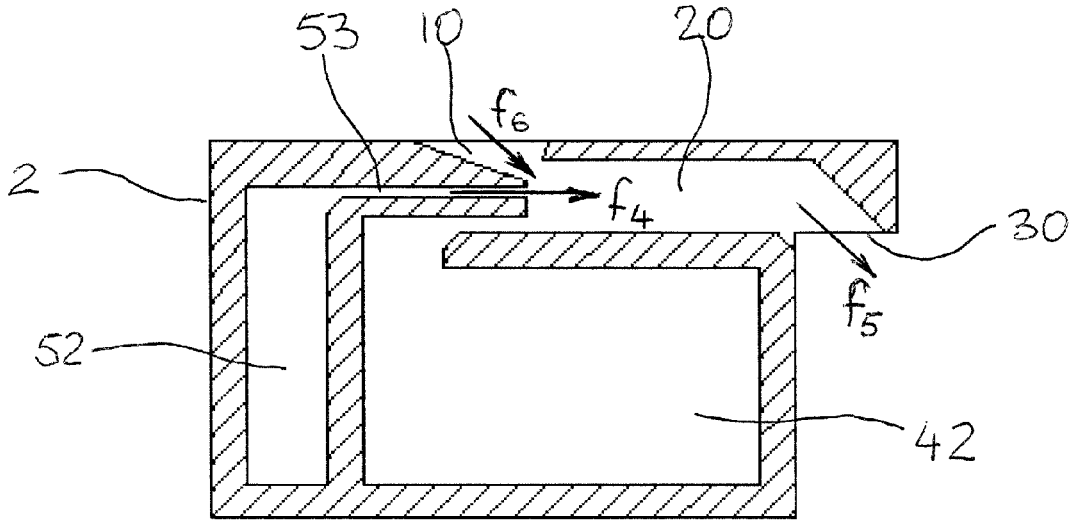
Fig. 4

BRAKING DEVICE FOR A FLAT ELEMENT IN SHEET FORM AND METHOD FOR CLEANING SUCH A DEVICE

CROSS-REFERENCE TO RELATED APPLICATIONS

The present application is a 35 U.S.C. §§371 National Phase conversion of PCT/EP2013/001165, filed Apr. 19, 2013, which claims priority of European Patent Application No. 12003418.6, filed May 3, 2012, the contents of which are incorporated by reference herein. The PCT International Application was published in the French language.

BACKGROUND OF THE INVENTION

The present invention concerns a device which allows the rear portion of a flat sheet element to be braked when the sheet element is displaced by being pulled by its front portion.

The invention also relates to methods for cleaning such a braking device.

The invention is used in a particularly advantageous manner, but not exclusively, in the area of the manufacture of cardboard packaging.

In that industry, the manufacture of packaging from a sheet of cardboard generally takes place in several stages. This is why converting machines known in the prior art are traditionally comprised of several successive operating stations, through which each sheet is displaced in a sequential manner. In concrete terms, each sheet is conveyed individually from one operating station to another by being pulled by its front edge, thus leaving the rest of the sheet without any particular support.

Despite influences due to movement of the sheet, the sheet maintains a certain flatness when it decelerates on arriving in an operating station. It is known to brake its rear portion during the introduction stage. Usually, a suction braking device is used for this which, as its name indicates, fulfills its function by retaining the rear portion of the sheet by means of suction while allowing the sheet to slide progressively while its front portion is displaced. In practice, such a braking device is generally in the form of a plate, which is provided with a plurality of holes through which suction is generated by the Venturi effect, and which is set up crosswise at the inlet of the operating station.

This type of suction braking device, however, has the disadvantage of becoming rapidly clogged. With the humidity of the air, the dust from the cardboard, anti-smudge powder and other residues naturally tend to accumulate in compact blocks at the different orifices and air circulation ducts in the suction plate.

A solution which is normally used to alleviate this problem consists in cleaning out the different ducts in the suction plate with a flexible tongue-shaped scraper. The dimensions of that tool are adapted to the lengths and to the sections of the ducts. In reality, the scraper is inserted through each suction hole, while the residues are removed through the corresponding exhaust orifice.

The disadvantage of such a cleaning technique is that can only be performed manually, which makes it particularly tedious. However, the most serious disadvantage is that the technique is sometimes quite simply impossible to implement because the braking device is quasi-inaccessible. This occurs each time the device is set up in a particularly congested environment, for example, at the inlet of a platen press of a converting machine.

Attempts have been made to develop suction braking devices provided with a self-cleaning function. In this respect, document EP1935820 discloses a device which classically includes a plurality of suction holes connected to several exhaust orifices by means of a network of air circulation ducts, as well as a principal pneumatic circuit responsible for injecting compressed air into the most downstream portion of the network and in the direction of the different exhaust orifices. The system is arranged to make use of the Venturi effect. The circulation of the pulsed air flow generates, in the most upstream portion of the circulation ducts, a vacuum which, in turn, generates a suction air flow through all the suction holes. However that may be, the cleaning of the different ducts takes place by means of blowing, by injecting compressed air in the direction of the suction holes using a secondary pneumatic circuit.

This type of braking device, however, has the disadvantage of incorporating a self-cleaning system which leads to removing the residues through the suction holes, and therefore to throwing them back in the direction of the sheet displacement path, that is the core of the converting machine. Harmful consequences of this are to ruin the cardboard sheets, but also to clog up the mechanisms which are located in the direct vicinity of the braking device.

SUMMARY OF THE INVENTION

Also, the technical problem to be solved by the object of the present invention is to propose a braking device to brake the rear portion of a flat sheet element when said latter is displaced by being pulled by its front portion. The braking device comprises at least one suction hole which communicates with an exhaust orifice via an air circulation duct, as well as a principal compressed air injection means which, in each circulation duct and in the direction of the corresponding exhaust orifice, are able to generate a principal pulsed air flow capable, by means of the Venturi effect, of generating a braking suction air flow through the corresponding suction hole, a braking device which would allow the problems of the prior art to be avoided by providing a self-cleaning capacity which is appreciably more efficient.

According to the present invention, the braking device furthermore comprises secondary compressed air injection means suitable for generating a secondary pulsed air flow, in each circulation duct and in the direction of the corresponding exhaust orifice, and that air flow is capable, by means of the Venturi effect, of generating a cleaning suction air flow through the corresponding suction hole.

The braking device of the invention includes at least one suction hole which communicates with an exhaust orifice via an air circulation duct. That signifies that the device can comprise one or several suction holes and one or several exhaust orifices, wherein the whole system being connected by a more or less complex network of air circulation ducts.

Within the framework of the invention, the principal air injection means are to operate in a markedly continuous manner, given that braking is a function which has to be ensured in a quasi-permanent manner so as to be suitable for the elevated rates at which the sheets are conveyed in modern processing machines. In contrast, the secondary air injection means, in turn, are to be implemented in a more intermittent manner, in view of the fact that cleaning is an operation which must be as short as possible so as not to disadvantage the performance of the processing machine with which the braking device is associated.

The invention has the advantage over the prior art of overcoming the problems of ruining and becoming clogged up insofar as the removal of the residues is effected integrally through the exhaust orifices, which by definition are turned in a direction markedly different to the sheet displacement path. In this case, and in contrast to its equivalent in the prior art described initially, it is not a process of cleaning the suction holes by blowing, generating a pulsed air flow which is oriented from the inside to the outside of the braking device and throwing back the residues directly through the suction holes.

In a braking device according to the invention, the cleaning of the suction holes takes place in an advantageous manner by means of suction, by utilizing a suction air flow which is oriented from the outside to the inside of the braking device, with removal of the residues uniquely through the exhaust orifices. The cleaning suction air flow is generated in an identical manner to the braking suction air flow, that is to say indirectly since it too results from a vacuum created by the Venturi effect following the circulation of a pulsed air flow through a duct with a non-constant section. However, the cleaning suction air flow is distinguished from the braking suction air flow by the fact that it is produced during a limited lapse of time and that it has a relatively elevated pressure, with the aim that its action is similar to a sort of gunshot effect.

The description is given, moreover, with reference to the accompanying drawings, in which:

FIG. 1 illustrates a processing machine in which is incorporated a cutting station which is provided with a braking device according to the invention.

FIG. 2 shows the braking device set up within the cutting station.

FIG. 3 is a cross section which shows the braking device in operating mode.

FIG. 4 constitutes a view similar to FIG. 3, but with the braking device in cleaning mode.

DESCRIPTION OF EMBODIMENTS

For reasons of clarity, the same elements have been designated by identical references. In the same way, only the elements essential to the understanding of the invention have been shown, with no respect to scale and in a schematic manner.

FIG. 1 shows a processing machine 100. The principal function is to cut a succession of flat elements, in this case cardboard sheets, to obtain blanks which are intended to be folded and subsequently glued to make folding boxes. As such a cutting machine 100 is known in the prior art, it will not be described in detail here, neither regarding its structure nor its operation.

Classically, such a machine is comprised of several operating stations 110, 120, 130, 140, 150, 160 which are juxtaposed in order to form a unitary system which is capable of processing a succession of sheets. Thus, there is a feeder 110 which is responsible for supplying the machine sheet by sheet, then a feed table 120 on which the sheets are spread out before being positioned individually in a precise manner, and a cutting station 130 which fulfills its function by means of a platen press 131. Then can be seen a stripping station 140 which allows for the removal of waste which is directly produced as the sheets are cut, followed by a delivery station 150 where the blanks are separated, and the role of the delivery station is to break the attachment points which join the blanks together in order to separate the blanks and then to repack them in stacks so as to make them directly usable in a folding-gluing machine, and finally to a removal station 160 where the residual waste is removed. Conveying means 170 are provided in order to move each sheet individually from the outlet of the feed table 120 up to the delivery station 150 by pulling it by its front edge. In a classic manner, the conveying means 170 use a series of gripper bars 171, which are mounted so as to be displaceable in a transverse manner, by means of two chain conveyors 172 which are disposed laterally on each side of the cutting machine 100.

FIG. 2 shows more precisely that the cutting station 130 is provided with a platen press 131 in which the sheets are cut between an upper platen 132 which is static and a lower platen 133 which is mounted so as to be displaceable following a vertical reciprocating movement. It can also be seen that the cutting station 130 incorporates a braking device 1 which, by means of suction, is responsible for braking the rear portion of each sheet when the sheet enters the platen press 131 by being pulled via its front edge by a gripper bar 171. The combined action of pulling the front and braking therefore advantageously allows the sheet to be kept in an extended position during the entire deceleration stage.

In this embodiment, for example, the braking device 1 is in the form of a suction plate 2 which is set up transversely at the inlet of the platen press 131, below but as close as possible to the path of displacement of the sheets 134 so as to be able to act on the inside face of the latter sheets.

As can be seen in FIGS. 3 and 4, the braking device 1 is initially provided with at least one suction hole 10 which opens out on the top surface of the plate 2, and which communicates with an exhaust orifice 30 via an air circulation duct 20, both of which are arranged in the bottom part of said plate 2. However, the braking device 1 is also provided with principal compressed air injection means 40 which are able to generate, in each circulation duct 20, a principal pulsed air flow (arrow f1) which is directed toward the corresponding exhaust orifice 30 (arrow f2). The system is arranged such that the circulation of the principal pulsed air flow, by means of the Venturi effect, generates a braking suction air flow (arrow f3) through each suction hole 10.

The braking device 1 has a self-cleaning ability. To this end, and in accordance with the object of the present invention, the braking device also comprises secondary compressed air injection means 50 which are capable of generating, in each circulation duct 20, a secondary pulsed air flow (arrow f4) which is directed toward the corresponding exhaust orifice 30 (arrow f5). The system, in this case, is designed such that the circulation of the secondary pulsed air flow, by means of the Venturi effect, generates a cleaning suction air flow (arrow f6) through each suction hole 10.

In said embodiment, the principal injection means 40 are provided in concrete terms with a compressed air source 41 which supplies an air-intake duct 42 which is arranged longitudinally across the suction plate 2. Said air-intake duct 42 communicates with a plurality of air-intake ducts 43 which open out respectively in the different air circulation ducts 20.

In an analogous manner, the secondary injection means 50, in turn, are provided with a compressed air source 51 which supplies an air-intake duct 52 which is arranged longitudinally across the suction plate 2. Said air-intake duct 52 communicates with a plurality of air-intake ducts 53 which open out respectively in the different air circulation ducts 20.

In practice, the cleaning suction air flow serves to detach the residues which are present in each suction hole 10, then to convey them as far as the associated air circulation duct 20. There, it is the secondary pulsed air flow which takes over in order to convey them as far as the corresponding exhaust orifice 30. Concurrently, said same secondary pulsed air flow is used in order to remove the residues which have accumulated along the air circulation duct 20, and in order to remove them through the exhaust orifice 30.

According to a characteristic of the invention, the secondary injection means 50 are capable of generating a secondary pulsed air flow in a temporary manner.

The secondary injection means 50 are preferably able to generate a secondary pulsed air flow during a lapse of time between 0.5 and 2 seconds inclusive.

According to another characteristic of the invention, the secondary injection means 50 are capable of generating a secondary pulsed air flow, the pressure of which is appreciably superior to that of the principal pulsed air flow, and, as a consequence, of generating a cleaning suction air flow, the pressure of which is appreciably superior to that of the braking suction air flow.

The secondary injection means 50 are preferably able to generate a secondary pulsed air flow, the pressure of which is between 8 and 12 bar inclusive.

Obviously, the invention also concerns any operating station intended to be incorporated in a processing machine for flat elements in sheet form, and including at least one braking device 1 as described previously. This includes, for example, a cutting station 130 as in the particular embodiment selected in order to illustrate the invention, but also a waste stripping station 140 or a delivery station 150.

However, in an even more general manner, the invention also relates to any processing machine for a succession of flat elements in sheet form, having at least one such braking device 1. This can include notably a cutting machine as in the embodiment for FIGS. 1 to 4, or even a printing machine working by stamping of metalized foils.

The invention finally concerns methods allowing the cleaning of any braking device 1 by means of suction such as described previously.

A first cleaning method is characterized by the fact that it comprises the stages of:

deactivating the principal injection means 40 if necessary, temporarily activating the secondary injection means 50.

In said first method for cleaning, the principal injection means 40 and the secondary injection means 50 are destined to operate in an alternate manner. This means that the principal injection means 40 are exclusively dedicated to the braking operation while only the secondary injection means 50 take part in the cleaning operation.

In a particularly advantageous manner, prior to the stage of deactivating the principal injection means 40, the first method for cleaning can be provided with a supplementary stage consisting in controlling the activation stage of said principal injection means 40.

In accordance with another advantageous characteristic, subsequent to the temporary activation stage of the secondary injection means 50, the first cleaning method can be provided with a supplementary stage consisting in reactivating the principal injection means 40.

A second method for cleaning is notable in itself in that it includes a stage consisting in temporarily activating the principal injection means 40 and the secondary injection means 50 in a simultaneous manner.

In said second method for cleaning, the braking function remains assured by the sole principal injection means 40, while the cleaning function is fulfilled by the combined action of the principal injection means 40 and the secondary injection means 50.

Other characteristics of the invention are applicable whatever the method for cleaning considered.

It is thus that the activation of the secondary injection means 50 preferably takes place during a lapse of time between 0.5 and 2 seconds inclusive.

Likewise in an analogous manner, the activation of the secondary injection means 50 is preferably realized at a secondary pulsed air flow pressure which is between 8 and 12 bar inclusive.

In a particularly advantageous manner, the method for cleaning is implemented in a periodic manner. The aim here is to carry out a preventive action to avoid any risk of the ducts becoming blocked. However, if the implementation is regular, its actual periodicity can be varied from one braking device to another. In practice, the periodicity will generally be a function of the quality of the processed sheets, of the nature of the mechanical work carried out in the station and of the manner in which each sheet is conveyed individually.

In accordance with another advantageous characteristic, prior to its implementation the method for cleaning includes the stages of:

interrupting the conveyance of flat objects upstream of the braking device 1, checking the presence of flat objects in the direct vicinity of the braking device 1, authorizing the implementation of the method for cleaning if no flat object is present in the vicinity of the braking device 1.

The invention claimed is:

1. A braking device for braking a rear portion of a flat element in sheet form when the sheet is displaced over a surface by pulling a front portion of the sheet, the braking device comprising:

a suction device including the surface;

the surface having at least one suction hole located to open at the surface over which the sheet is being advanced;

the suction device having an air exhaust orifice through which suction air exits the device and an air circulation duct which communicates between the suction hole and the exhaust orifice;

a principal compressed air injection device configured and located to supply air to the circulation duct and in the direction of the exhaust orifice, the principal air injection device is configured to generate a principal pulsed air flow past the suction hole and the principal pulsed air flow is capable of creating a Venturi effect for generating a braking suction air flow through the suction hole and into the circulation duct;

a secondary compressed air injection device configured and located for generating, in the circulation duct and through the exhaust orifice a secondary pulsed air flow which is capable of creating the Venturi effect and of thereby generating a cleaning suction air flow through the corresponding suction hole.

2. A braking device according to claim 1, wherein the secondary injection device is configured for generating a secondary pulsed air flow selectively in a temporary manner.

3. A braking device according to claim 2, wherein the secondary injection device is configured for generating a secondary pulsed air flow during a time period of between 0.5 and 2 seconds.

4. A braking device according to claim 1, wherein the secondary injection device is configured for generating a secondary pulsed air flow at a pressure greater than the pressure of the principal pulsed air flow for generating a cleaning suction air flow greater than that of the braking suction air flow and capable of cleaning the suction hole by the cleaning suction air flow.

5. A braking device according to claim 4, wherein the secondary injection device is configured for generating a secondary pulsed air flow at a pressure between 8 and 12 bar.

6. A station for operating a succession of flat elements in sheet form, wherein the station comprises at least one braking device according to claim 1.

7. A processing machine for a succession of flat elements in sheet form, wherein the processing machine comprises a braking device according to claim 1.

8. A method for cleaning a braking device by suction according to claim 1, wherein the method comprises the stages of:

deactivating the principal injection device; and temporarily activating the secondary injection device for cleaning the suction hole by the cleaning suction air flow.

9. A method for cleaning according to claim 8, wherein prior to deactivating the principal injection device, the method comprises stages:

interrupting conveyance of flat objects at a location upstream of the braking device;

detecting the presence of flat objects in the vicinity of the braking device;

authorizing implementation of the method of cleaning if no flat object is detected as present in the vicinity of the braking device.

10. A method for cleaning according to claim 8, wherein the activation of the secondary injection device takes place at a secondary pulsed air flow pressure between 8 and 12 bar.

11. A method for cleaning according to claim 8, further comprising a stage of controlling the activation state of the principal injection device prior to the stage of deactivating the principal injection device.

12. A method for cleaning according to claim 11, further comprising a stage of reactivating the principal injection device after the stage of temporarily activating the secondary injection device.

13. A method for cleaning according to claim 8, wherein the activation of the secondary injection device takes place during a time period of between 0.5 and 2 seconds.

14. A method for cleaning according to claim 8, wherein the method is implemented in a periodic manner.

15. A method for cleaning a braking device according to claim 1, by suction comprising a stage of temporarily activating the principal injection device and the secondary injection device in a simultaneous manner.

* * * * *